United States Patent [19]

Bald et al.

[11] Patent Number: 4,598,566

[45] Date of Patent: Jul. 8, 1986

[54] FOUR-HIGH ROLL STAND WITH OFFSET WORKING ROLLS

[75] Inventors: Wilfried Bald, Hilchenbach; Erich Stoy, Ratingen; Hans Römmen, Dormagen; Hans-Friedrich Heisterkamp, Krefeld, all of Fed. Rep. of Germany

[73] Assignee: SMS Schloemann-Siemag AG, Dusseldorf, Fed. Rep. of Germany

[21] Appl. No.: 587,231

[22] Filed: Mar. 7, 1984

[30] Foreign Application Priority Data

Mar. 11, 1983 [DE] Fed. Rep. of Germany ..... 3308673

[51] Int. Cl.[4] ..... B21B 31/16

[52] U.S. Cl. ..... 72/243; 72/245

[58] Field of Search ..... 72/21, 240, 241, 242, 72/243, 248

[56] References Cited

U.S. PATENT DOCUMENTS

| | | | |
|---|---|---|---|
| 1,864,299 | 6/1932 | Fawell | 72/243 |
| 2,927,489 | 3/1960 | Teutsch | 72/243 |
| 3,003,373 | 10/1961 | Volkausen | 72/243 |
| 4,059,002 | 11/1977 | Rommen et al. | 72/242 |

FOREIGN PATENT DOCUMENTS

| | | |
|---|---|---|
| 2522213 | 8/1979 | Fed. Rep. of Germany . |
| 1777054 | 5/1980 | Fed. Rep. of Germany . |
| 3212070 | 10/1982 | Fed. Rep. of Germany . |
| 23508 | 2/1983 | Japan..... |

*Primary Examiner*—Lowell A. Larson
*Assistant Examiner*—Jorji M. Griffin
*Attorney, Agent, or Firm*—Karl F. Ross; Herbert Dubno

[57] ABSTRACT

A roll stand has a frame and a pair of small-diameter and substantially parallel working rolls defining a workpiece nip. Thus a strip to be rolled passes in a horizontal upstream-to-downstream direction through the nip. Respective pairs of upper and lower upstream support levers have outer ends pivoted on the frame and inner ends downstream therefrom and respective pairs of upper and lower downstream support levers have outer ends pivoted on the frame downstream of the nip and inner ends pivoted on the inner ends of the upstream levers. Respective pairs of journal blocks mounted on the inner ends of the levers support the working rolls for rotation about substantially parallel axes flanking the nip. A pair of large-diameter and substantially parallel backup rolls flank and bear toward the nip on the working rolls and are rotatable in the frame about substantially parallel axes flanking the working-roll axes and offset therefrom in the direction. Respective upstream and downstream vertically expansible actuators are braced between the upstream and downstream levers between the respective inner and outer ends thereof for vertically bending the working rolls.

12 Claims, 11 Drawing Figures

FOUR-HIGH ROLL STAND WITH OFFSET WORKING ROLLS

FIELD OF THE INVENTION

The present invention relates to a roll stand whose working rolls are offset in the travel direction from the plane of the backup rolls. More particularly this invention concerns such a stand having four rolls and wherein the working rolls are offset downstream to the backup rolls.

BACKGROUND OF THE INVENTION

A standard four-high rolling stand of the type used for rolling strip steel has a pair of vertically spaced nip-defining working rolls of relatively small diameter. Respective upper and lower backup rolls of larger diameter bear respectively down and up toward the nip on the respective working rolls. Thus the bendability of the small-diameter working rolls is largely canceled out by the rigidity of the larger-diameter backup rolls so that the large forces required for rolling can be brought to bear on the workpiece.

As described in German patent document No. 1,777,054 filed June 28, 1966 by K. Leifeld and E. Stoy and in German patent document No. 3,212,070 filed by H. Ishikawajima with a claim to a Japanese priority of Apr. 2, 1981, roll stands are known wherein the working rolls are driven by the backup rolls and one of them is centered on an axis offset from the plane of the backup rolls and the other working roll, typically downstream therefrom relative to the workpiece travel direction.

In these arrangements the roll ends can be twisted to horizontally and vertically bend the working rolls in an effort to cancel out the inward bending of the rolls that normally results during rolling. The intent is of course to produce a workpiece of perfect surface planarity and uniform thickness, as described in copending and commonly owned patent application Nos. 352,520 filed Feb. 26, 1982 by W. Bald, Ser. No. 558,165 filed 12-5-83, filed by H. Rommen et al, and Ser. No. 555,458 filed 11-28-83, filed also by H. Rommen et al. German patent document No. 2,522,213 filed May 17, 1975 by H. Rommen and E. Stoy further describes such an arrangement that achieves a complex three-dimensional bending of one of the working rolls. This structure also is enormously complicated and hard to control.

In the arrangement with an offset working roll the offset roll is substantially smaller in diameter than the one that is coplanar with the other rolls. This therefore also complicates the construction of the equipment.

OBJECTS OF THE INVENTION

It is therefore an object of the present invention to provide an improved roll stand.

Another object is the provision of such a roll stand which overcomes the above-given disadvantages, that is which allows complex bending of the working rolls in a simple and easy to control structure.

SUMMARY OF THE INVENTION

A roll stand according to the invention has a frame and a pair of small-diameter and substantially parallel working rolls defining a workpiece nip. Thus a strip to be rolled passes in a horizontal upstream-to-downstream direction through the nip. Respective pairs of upper and lower upstream support levers have outer ends pivoted on the frame and inner ends downstream therefrom and respective pairs of upper and lower downstream support levers have outer ends pivoted on the frame downstream of the nip and inner ends pivoted on the inner ends of the upstream levers. Respective pairs of journal blocks mounted on the inner ends of the levers support the working rolls for rotation about substantially parallel axes flanking the nip. A pair of large-diameter and substantially parallel backup rolls flank and bear toward the nip on the working rolls and are rotatable in the frame about substantially parallel axes flanking the working-roll axes and offset therefrom in the direction. Respective upstream and downstream vertically expansible actuators are braced between the upstream and downstream levers between the respective inner and outer ends thereof for vertically bending the working rolls.

According to another feature of this invention at least one horizontally expansible actuator is braced between the frame and the outer ends of at least one of the pairs of levers for horizontally bending the respective working roll. In addition the outer ends of the one pair of levers are horizontally displaceable in the frame.

It is possible with the system of this invention to achieve all the shape variations necessary for production of a nearly perfectly flat workpiece merely by complex three-dimensional bending of one of the working rolls. This makes it possible to cancel out complex deformations of the workpiece, even waviness of a complex form. Relatively small-diameter working rolls can be bent with the system of this invention to cancel out even relatively localized deformations on the workpiece.

The stand according to this invention has inner pivots defining pivot axes parallel to the roller axes and interconnecting the inner lever ends and the outer ends of the upstream levers are limitedly displaceable in the frame toward and away from the nip. Such interconnection maintains the working rolls solidly in place once their positions are set. In addition an upstream pivot defines a single pivot axis parallel to the roller axes upstream of the nip and both of the outer ends of the upstream levers are pivoted about the pivot axis on the pivot.

The journal blocks and levers according to this invention are formed with complementary interengaging and horizontally extending formations. Thus the journal blocks can slide horizontally parallel to the axes out of the levers for changing of the working rolls.

These actuators are horizontal cylinders and are operated by control means including sensors for detecting the shape of the working rolls and for pressurizing the cylinders in accordance with the detected shape. Respective pusher rollers braced between the horizontally expansible actuators and the working rolls are rotatable about axes parallel to the working-roll axes. Guide formations support the pusher rollers and permit same to be withdrawn axially from the stand.

The roll stand of this invention also has respective downstream pivots defining downstream pivot axes parallel to the roller axes downstream of the nip. The downstream ends of the downstream levers are pivoted on the respective downstream pivots and respective pusher rollers are braced between the horizontally expansible actuators and the working rolls and are rotatable about axes parallel to the working-roll axes. These pusher rollers are supported for rotation about respective axes displaceable horizontally through a stroke extending horizontally upstream and downstream of the downstream pivot axes.

In accordance with another feature of this invention means is provided including an abutment on the frame engageable with at least one of the lower levers for limiting downward pivoting of the inner ends. The inner ends of at least one of the pairs of levers are formed with a pair of C-section confronting guide rails extending parallel to the axes and the working-roll journal blocks are formed with axially extending ridges engaged in the rails. Thus the working rolls with their journal blocks can be withdrawn axially from the stand.

DESCRIPTION OF THE DRAWING

The above and other features and advantages will become more readily apparent from the following, reference being made to the accompanying drawing in which.

FIGS. *7a, 7b, 7c,* and *7d* are diagrams illustrating several rolling nips produced by extreme values of the two types of bending systems according to this invention.

SPECIFIC DESCRIPTION

Figure 1:
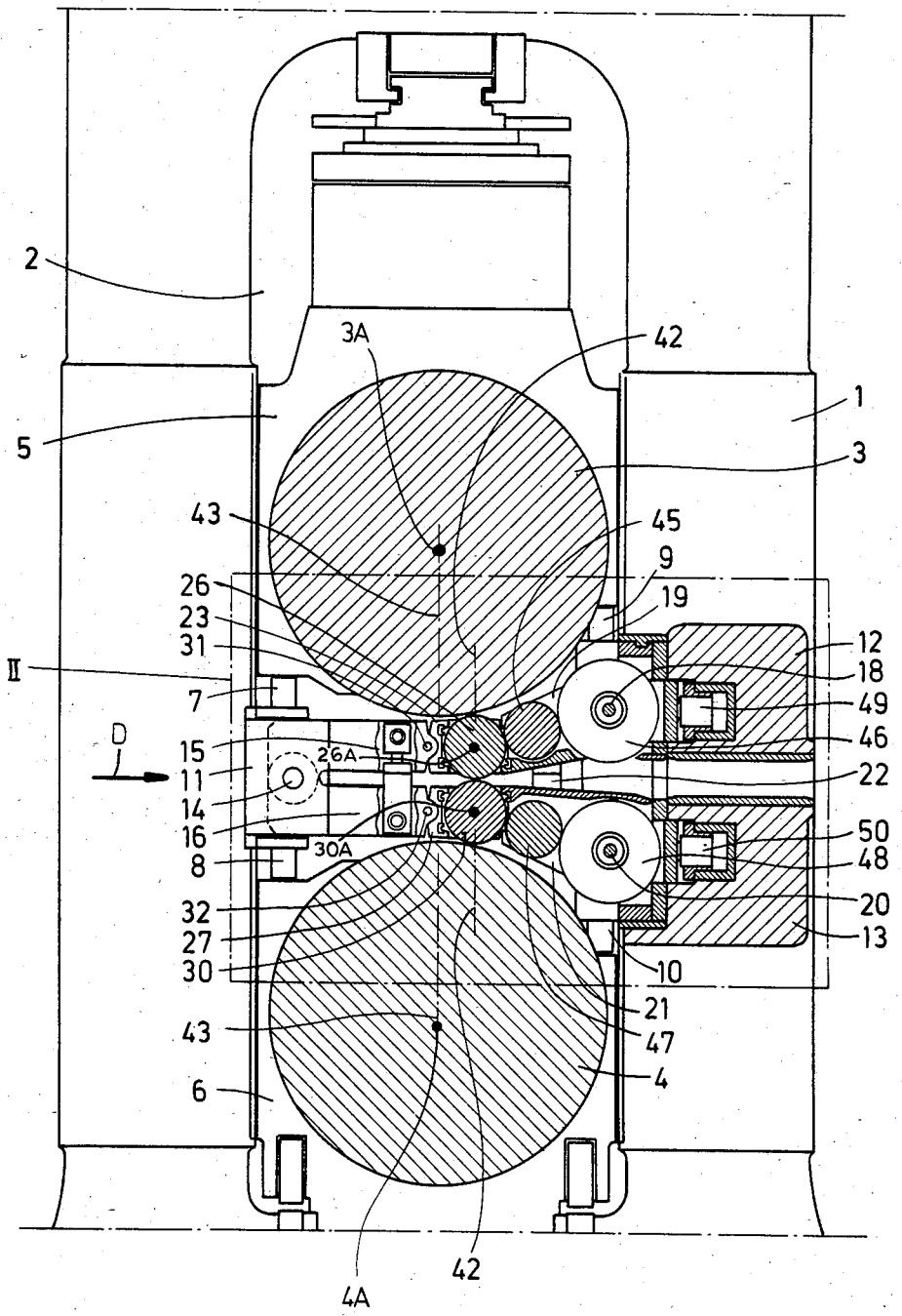
FIG. 1 is a vertical section through a roll stand according to this invention.
Figure 2:
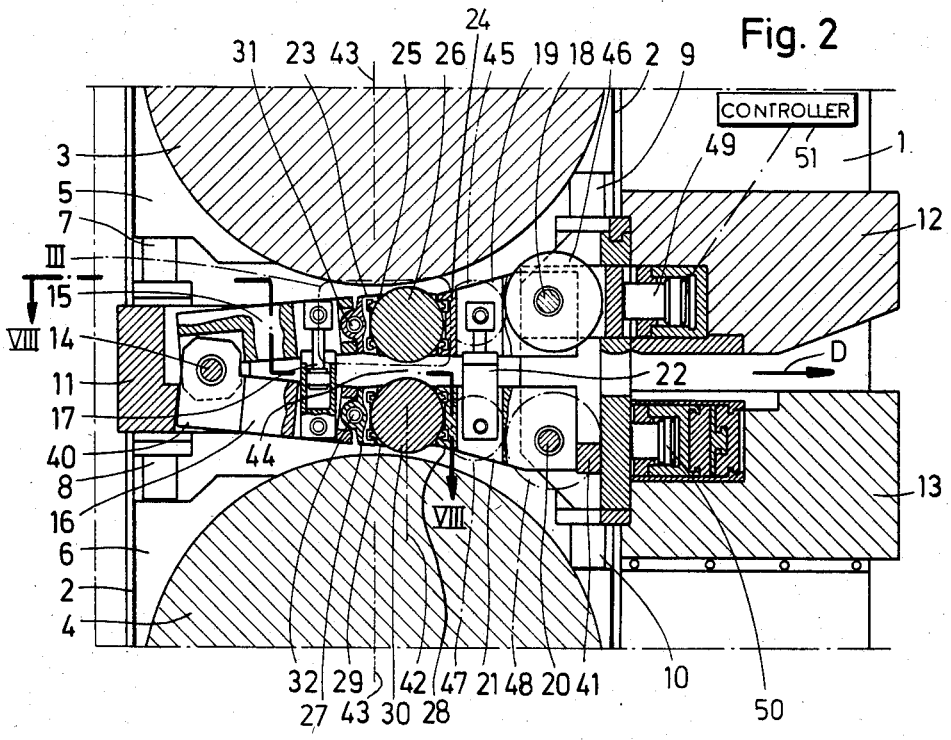
FIG. 2 is a large-scale view of the detail indicated in box II of FIG. 1.

As seen in FIG. 1 a roll stand has a frame 1 formed with a horizontally open window 2 in which two large-diameter backup rolls 3 and 4 are rotatable about respective parallel and vertically spaced axes 3A and 4A in respective vertically displaceable journal blocks 5 and 6. Heavy duty cylinders 7, 8, 9 and 10 fixed in the frame 1 vertically engage these blocks 5 and 6 and can set the vertical spacing between the axes 3A and 4A as is well known. Obviously each roll 3 and 4 is supported at each axial end on one such journal block 5 and 6 in a window 2 of a respective half of the frame 1.

Relative to a horizontal workpiece travel direction D, upstream of the vertical plane 43 formed by the axes 3A and 4A the frame 1 is provided with a beam 11 extending parallel to these axes and downstream therefrom the frame 1 has two such beams 12 and 13 that are vertically spaced from each other. The upstream transverse beam 11 is provided with a horizontal pivot 14 extending parallel to the axes 3A and 4A and equidistant therebetween. The upstream or outer ends of two vertically superposed and generally identical levers 15 and 16 are pivoted at 14.

Similarly the downstream or outer ends of two vertically superposed and generally identical levers 19 and 21 are pivoted at vertically spaced pivots 18 and 20 on the downstream transverse beams 12 and 13. The levers 15, 16, 19, and 21 have inner ends pivoted together at respective upper and lower central pivots 31 and 32 that lie slightly upstream of the plane 43 of the axes 3A and 4A. Somewhat downstream of the plane 43 on the inner ends of the downstream levers 19 and 21 are two small-diameter working rolls 26 and 30 centered on axes 26A and 30A that define a vertical plane 42 offset downstream of the plane 43 by a difference equal to about half the diameter of the working rolls 26 and 30, which diameter in turn is equal to about one-fifth of the diameter of the backup rolls 3 and 4.

Figure 8:
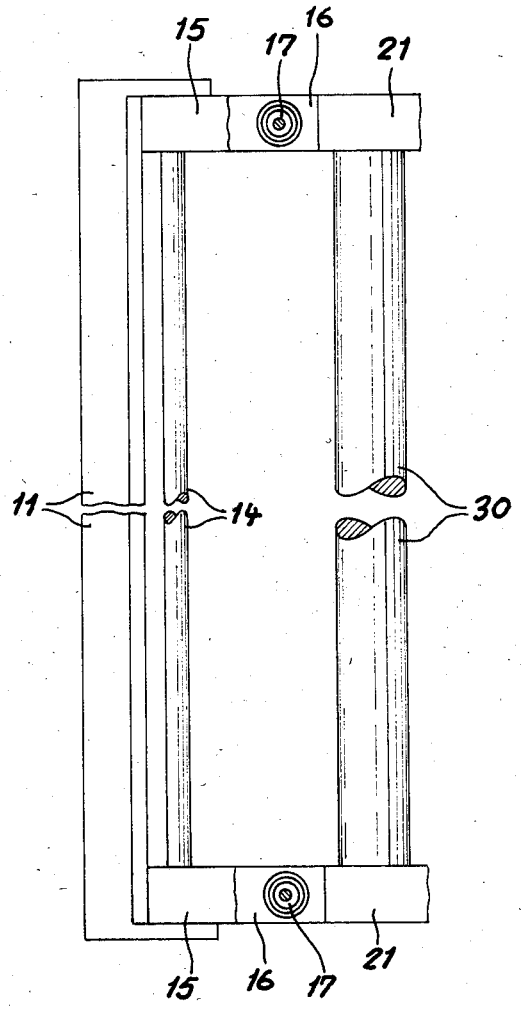
FIG. 8 is a sectional view taken along line VIII—VIII of FIG. 2.

Vertically braced between the upstream levers 15 and 16 at a location upstream of the plane 43 are a pair of hydraulic actuating cylinders 17, and vertically braced between the downstream levers 19 and 21 downstream of the working rolls 26 and 30 are similar such actuators 22. Of course one such set of levers 15, 16, 19, and 21 and actuators 17 and 22 is provided at each axial end of the stand according to this invention, as is seen in FIG. 8 of the drawing.

Figure 3:
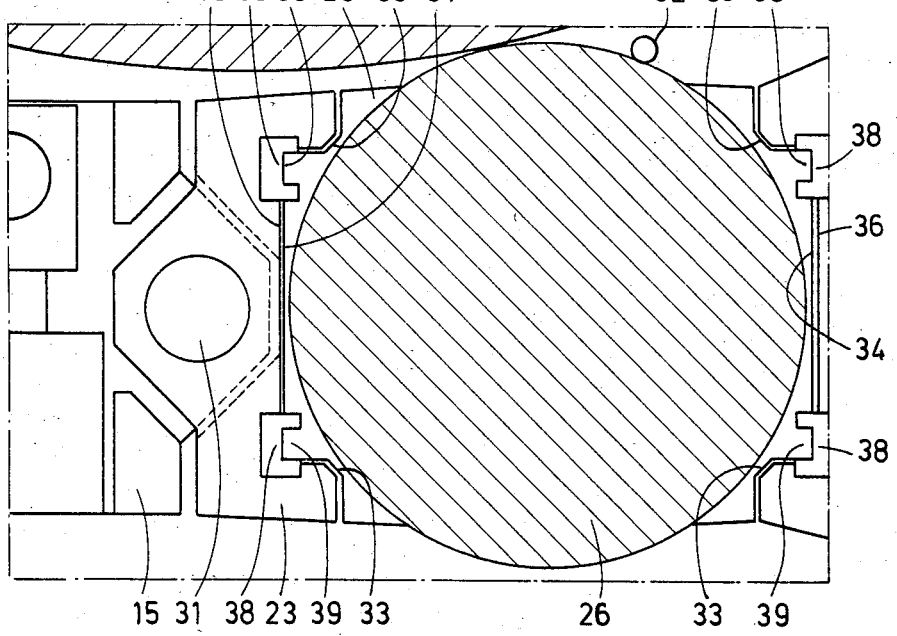
FIG. 3 is a large-scale view of the detail indicated in box III of FIG. 2.

The rolls 26 and 30 are carried in respective journal blocks 25 and 29 held between respective holders 23, 24, and 27, 28 in the downstream levers 19 and 21. These holders and the blocks are identical. As shown in FIG. 3 each block 25 has cut-in corners 33 that define horizontal front and rear projections 34 having upper and lower edges formed as rails 39 extending axially and received in C-section guides 38 in forwardly and rearwardly open recesses 35 and 36 of the lever 19. In addition the front lever 16 has a lower front end constituted as an abutment 40 engageable with the front beam 11 and the rear lever 21 is similarly formed as an abutment 41 engageable with the beam 13. These abutments 40 and 41 define a lowermost position for the lower levers 16 and 21, in which the roll 30 can be extracted axially from the machine with its blocks 29. In this position the actuators 17 and 22 can similarly define a predetermined position for the upper working roll 26 so it can similarly be extracted axially with its blocks 25.

The working rolls 26 and 30 can be bent vertically toward the rolls 3 and 4 as well as toward the nip 44 by means of the cylinder actuators 17 and 22.

In addition one or both of the rolls 26 and 30 can be bent horizontally also. Thus according to this invention the upper roll 26 bears downstream on an intermediate pusher roll 45 journaled in the levers 19 and bearing in turn downstream on another pusher roll 46 which is supported on the beam 12. Similarly the lower working roll 30 bears directly on an intermediate pusher roll 47 and therethrough on a pusher roll 48 carried on the beam 13. A horizontal bender 49 carried in the beam 12 can push the rearmost pusher roll 46 forward, from a position with its axis behind the axis of the pivot 18 to a position with its axis in front of this pivot 18. A similar such actuator 50 carried in the beam 13 can push on the rearmost lower pusher roll 48 and therethrough can horizontally bend the lower working roll 30. To this end each intermediate roll 45 and 47 is horizontally limitedly displaceable in the respective levers 19 and 21. Such displaceability not only makes horizontal bending possible, but also allows different sizes of working rolls to be used. The actuators 49 and 50 are controlled by a controller 41 having a sensor 52 (FIG. 3) which detects the shape of the respective roll 26 or 30 and corrects it in accordance with the shape of the workpiece downstream of the nip 44.

It is within the scope of this invention to dispense with either of the actuators 49 or 50 and only bend one or the other working rolls 26 or 30. In addition the pivot 14 provided on the front beam 11 can be horizontally displaceable therein, and movable by means of an actuator like the actuators 49 and 50. This is useful when the transport direction D is reversed.

Figure 4:
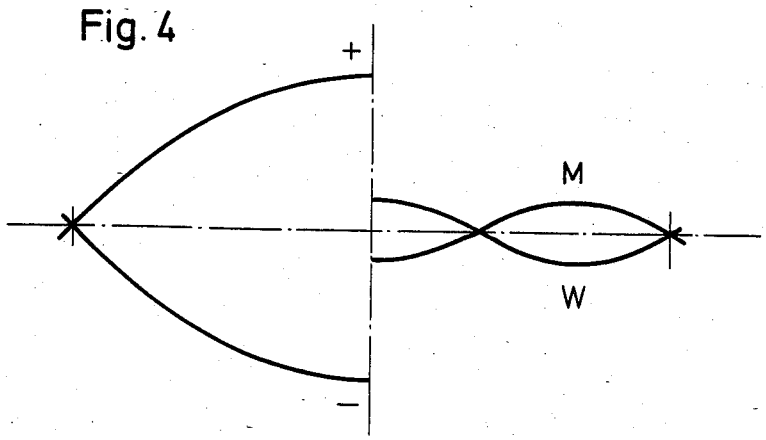
FIG. 4 is a diagram illustrating the horizontal bending of the working rolls produced by the lateral support together with the lateral component of the rolling force.
Figure 5:
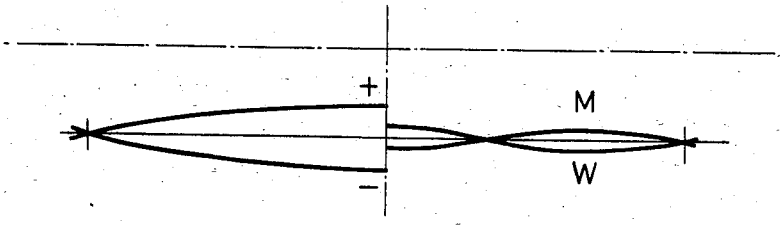
FIG. 5 is a diagram illustrating bending of the working roll as in FIG. 4 but when same is offset from the backup rolls.

FIG. 4 shows the horizontal bending in a four-high roll stand of the described type. The left side of FIG. 4 shows the possible shape of the working roll as a parabolic first order. The right side shows a second-order bent setting which is of the so-called M- or W-shape that can be used with relatively small-diameter working rolls. FIG. 5 illustrates which vertical components are produced by the horizontal bending of FIG. 4 with offcenter arrangement of the working rolls. The left side of FIG. 5 illustrates a first-order parabolic shape while the right side shows the second-order M- or W-shaped bent shape.

Figure 6:
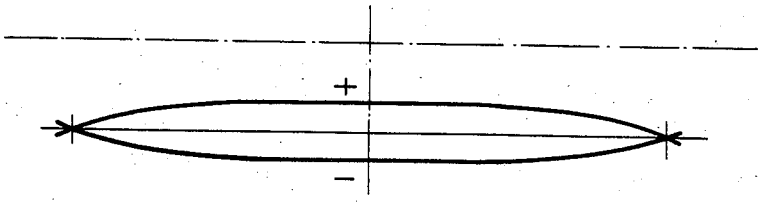
FIG. 6 is a diagram illustrating the effect of the vertical bending on the working rolls under certain width and loading conditions.
Figure 7A:
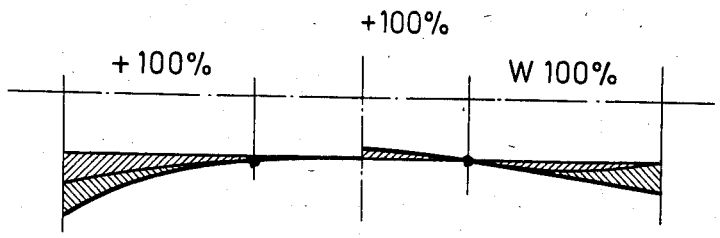
Figure 7B:
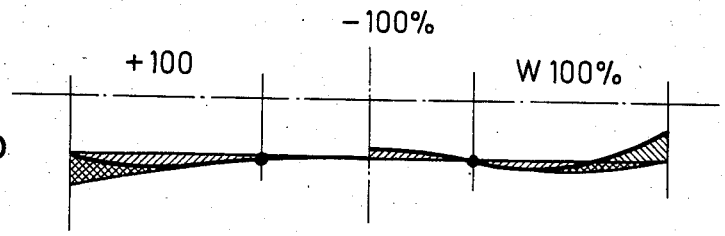
Figure 7C:
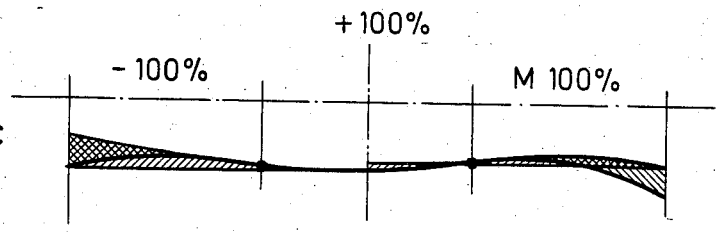
Figure 7D:
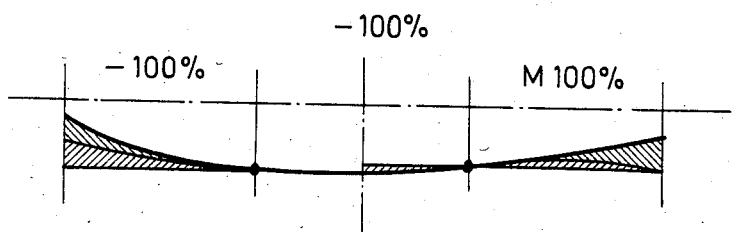

FIG. 6 illustrates the effect of the vertical bending on the working roll pins of certain widths and loads. Finally FIGS. *7a* through *7d* show various roll profiles which are produced by the combined effect of horizontal and vertical bending of the working rolls. FIG. *7a* and *7b* show the cumulative effects of both bending effects while FIGS. *7c* and *7d* show how the combined effect of two types of bending can produced rolls bent into second-order shapes.

With the system of this invention it is therefore possible to achieve complex three-dimensional bending of the working rolls so that virtually any deformation of the workpiece can be compensated out. Even the M- or W-shape that is occasionally created can be canceled out by appropriate bending of the working rolls in the horizontal and vertical directions. Even bending of only one of the rolls can have a considerable corrective effect.

We claim:

1. A roll stand comprising:

a frame;

a pair of small-diameter and substantially parallel working rolls defining a workpiece nip, whereby a strip to be rolled passes in a horizontal upstream-to-downstream direction through the nip;

respective pairs of upper and lower upstream support levers having outer ends pivoted on the frame and inner ends downstream therefrom and generally at the nip;

respective pairs of upper and lower downstream support levers having outer ends pivoted on the frame downstream of the nip and inner ends upstream therefrom and pivoted on the inner ends of the upstream levers;

respective pairs of upper and lower journal blocks mounted on the inner ends of the respective upper and lower levers and supporting the respective working rolls for rotation about substantially parallel axes vertically flanking the nip;

a pair of large-diameter and substantially parallel backup rolls flanking and bearing toward the nip on the working rolls and rotatable in the frame about substantially parallel axes vertically flanking the working-roll axes and offset therefrom in the direction; and means including respective upstream and downstream vertically expansible hydraulic cylinders braced between the upstream and downstream levers between the respective inner and outer ends thereof for vertically bending the working rolls.

2. The roll stand defined in claim 1, further comprising means including at least one horizontally expansible actuator braced between the frame and the outer ends of at least one of the pairs of levers for horizontally bending the respective working roll.

3. The roll stand defined in claim 2 wherein the outer ends of the one pair of levers are horizontally displaceable in the frame.

4. The roll stand defined in claim 2, further comprising inner pivots defining pivot axes parallel to the roller axes and interconnecting the inner lever ends.

5. The roll stand defined in claim 2 wherein the outer ends of the upstream levers are limitedly displaceable in the frame toward and away from the nip.

6. The roll stand defined in claim 2 further comprising an upstream pivot defining a single pivot axis parallel to the roller axes upstream of the nip, both of the outer ends of the upstream levers being pivoted about the pivot axis on the pivot.

7. The roll stand defined in claim 2 wherein the journal blocks and levers are formed with complementary interengaging and horizontally extending formations, whereby the journal blocks can slide horizontally parallel to the axes out of the levers for changing of the working rolls.

8. The roll stand defined in claim 2 wherein the actuators are horizontal cylinders, the stand further comprising control means including sensors for detecting the shape of the working rolls and for pressurizing the horizontal cylinders in accordance with the detected shape.

9. The roll stand defined in claim 2, further comprising respective pusher rollers braced between the horizontally expansible actuators and the working rolls and rotatable about axes parallel to the working-roll axes; and guide formations supporting the pusher rollers and permitting same to be withdrawn axially from the stand.

10. The roll stand defined in claim 2, further comprising:

respective downstream pivots defining downstream pivot axes parallel to the roller axes downstream of the nip, the downstream ends of the downstream levers being pivoted on the respective downstream pivots;

respective pusher rollers braced between the horizontally expansible actuators and the working rolls and rotatable about axes parallel to the working-roll axes; and means supporting the pusher rollers for rotation about respective axes displaceable horizontally through a stroke extending horizontally upstream and downstream of the downstream pivot axes.

11. The roll stand defined in claim 1, further comprising means including an abutment on the frame engageable with at least one of the lower levers for limiting downward pivoting of the inner ends.

12. The roll stand defined in claim 1 wherein the inner ends of at least one of the pairs of levers are formed with a pair of C-section confronting guide rails extending parallel to the axes, the working-roll journal blocks being formed with axially extending ridges engaged in the rails, whereby the working rolls with their journal blocks can be withdrawn axially from the stand.

* * * * *